United States Patent [19]

Krüger

[11] 4,412,389

[45] Nov. 1, 1983

[54] METHOD OF AUTOMATICALLY CONTROLLING THE DRYING PROCESS IN A LAUNDRY-DRYING SYSTEM, AND EQUIPMENT FOR PERFORMING THE METHOD

[75] Inventor: Manfred Krüger, Berlin, Fed. Rep. of Germany

[73] Assignee: Bosch-Siemens Hausgeräte GmbH, Stuttgart, Fed. Rep. of Germany

[21] Appl. No.: 290,513

[22] Filed: Aug. 6, 1981

[30] Foreign Application Priority Data

Aug. 14, 1980 [DE] Fed. Rep. of Germany ..... 3030864

[51] Int. Cl.[3] ..... F26B 21/10

[52] U.S. Cl. ..... 34/46; 34/53; 34/55; 34/48

[58] Field of Search ..... 34/44, 45, 46, 48, 54, 34/53, 55

[56] References Cited

U.S. PATENT DOCUMENTS 3,526,968 9/1970 Triplett ..... 34/48
4,267,643 5/1981 Haried ..... 34/48

FOREIGN PATENT DOCUMENTS 1565100 2/1970 Fed. Rep. of Germany .
2155710 3/1973 Fed. Rep. of Germany .
2405144 8/1975 Fed. Rep. of Germany .
1521532 8/1978 United Kingdom .

*Primary Examiner*—Larry I. Schwartz
*Attorney, Agent, or Firm*—Herbert L. Lerner; Laurence A. Greenberg

[57] ABSTRACT

Method and device of automatically controlling the drying process of a laundry drying system until a given desired degree of dryness is reached, including heating means, a drive for the drying system, a control device for controlling the drive and heating means, and means for supplying system-related fixed data concerning the drying of particular laundry, which includes determining the gradient of rising temperature in the drying system during a given early phase of the drying process, calculating a required operating time for the heating means and the drive from the determined gradient and the system-related fixed data, and feeding the calculated operating time as an input to the control device.

29 Claims, 4 Drawing Figures

METHOD OF AUTOMATICALLY CONTROLLING THE DRYING PROCESS IN A LAUNDRY-DRYING SYSTEM, AND EQUIPMENT FOR PERFORMING THE METHOD

The invention relates to a method of automatically controlling the drying process in a laundry-drying system until a desired degree of dryness is obtained, and to a device for performing the method.

Control methods for laundry dryers that are known, end the drying process in dependence on a measured value, which approximately corresponds to a desired residual moisture content. These methods which are described in German Published, Non-Prosecuted Applications DE-OS Nos. 21 55 710 and 24 05 144, are controlled either by a direct dependence on the measured residual moisture (laundry resistance and electrostatic charge of the laundry), or are controlled in dependence on a resistance change of a sensor disposed in the exhaust air duct caused by the temperature rise at the end of the drying process, as is shown in German Published, non-Prosecuted Application DE-OS No. 15 65 100. These control methods require great expenses for additional measuring and control means, and furthermore give no clue to the operator about the still to be expected duration of the drying process in operation.

Furthermore, drying processes are known which are purely controlled with respect to time, wherein only a timer is set at the beginning of the drying process, which gives continuous information about the expected length of the still-running drying process as it runs down. However, these drying processes which are only time-controlled are problematic with respect to the dryness to be achieved due to their great inaccuracy. Either the laundry is too wet, or it is dried too much. To avoid the overdrying, the drying temperature can be kept low, however, in this case the drying process takes too long.

It is accordingly an object of the invention to provide a method of automatically controlling the drying process in a laundry-drying system, and equipment for performing the method, which overcomes the hereinafore-mentioned disadvantages of the heretofore-known methods and equipment of this general type, and which makes it possible to achieve a residual moisture very close to the desired value, yet still allows the possibility of obtaining information about the length of the still running drying process which is to be expected.

With the foregoing and other objects in view there is provided, in accordance with the invention, a method of automatically controlling the drying process of a laundry drying system until a given desired degree of dryness is reached, including heating means, a drive for the drying system, a control device for controlling the drive and heating means, and means for supplying system-related fixed data concerning the drying of particular laundry which comprises determining the gradient of rising temperature in the drying system during a given early phase of the drying process, calculating a required operating time or duration for the heating means and the drive from the determined gradient and the other system-related fixed data, and feeding the calculated operating time as an input to the control device.

In accordance with another mode of the invention, there is provided a method which comprises supplying the type of laundry and the desired degree of dryness as the fixed data. The determination of the temperature gradient makes certain that the end of the operation time can be sufficiently accurately established by the combination of this factor with the hereinafore-mentioned other data, because the temperature behavior is known and can be calculated, and always repeats in the same way again. The system related fixed data therefore relates to the heat capacity of the drying system and the data about the introduced laundry relates to the capability of the laundry to transfer the moisture content to the surrounding air. The type of laundry and the desired degree of dryness can be set by the operator into a program selector switch of the machine, and are internally associated in the machine with certain calculation data. The control device itself can be a clock or timer having a completion time that can be set depending on the calculated operating time.

In accordance with a further mode of the invention, there is provided a method which comprises beginning the early phase of the drying process when the drying system is switched on. This variation keeps the instrumentation cost very low; however, it must be taken into account that the heat capacity of the drying system is also included in the measurement.

In accordance with an added mode of the invention, there is provided a method which comprises beginning the early phase of the drying process when a given minimum temperature is reached after the drying system and the laundry to be dried have reached substantially the same temperature. With a slightly higher investment in instrumentation for additional temperature measurement, the determination of the temperature gradient can be made independent of technically uncertain factors.

In accordance with an additional mode of the invention, there is provided a method which comprises measuring and taking into account the temperature difference existing between the drying system and the surrounding air before the beginning of the drying process, during the determination of the temperature gradient. This is done because if the early phase begins when the drying system is turned on, the drying apparatus might still be warm from a previous drying cycle. According to the afore-mentioned method, it is possible to eliminate this error or disturbing factor.

In accordance with again another mode of the invention, there is provided a method which comprises measuring the time interval between the occurrence of two fixed temperature values for determining the temperature gradient. In this case these temperature values are set, and the time it takes for the two values to be reached during the drying process is observed.

In accordance with again a further mode of the invention, there is provided a method which comprises measuring the temperature change between two fixed points in time for determining the temperature gradient. This variation has the advantage that time intervals can be easily represented by electronic circuits.

In accordance with again an added mode of the invention, there is provided a method which comprises displaying the time remaining until the calculated end of the drying process.

In accordance with again an additional mode of the invention, there is provided a method which comprises setting a fictitious operating time until the calculated operating time becomes available, and correcting the fictitious operating time when the calculated operating time is available.

In accordance with the apparatus of the invention, there is provided a device for performing a method of automatically controlling the drying process of a laundry drying system until a given desired degree of dryness is reached, comprising heating means, a drive for the drying system, a process control unit connected to the heating means and drive for controlling the drying process, means for supplying system-related fixed data concerning the drying of particular laundry, means for determining the gradient of rising temperature in the drying system during a given early phase of the drying process, and a computing unit including the temperature gradient determining means and being connected to the fixed data, supplying means and the process control unit for calculating a required operating duration or time for the heating means and drive from the determined gradient and the other system-related fixed data and feeding the calculated operating time as an input to the process control unit.

In accordance with another feature of the invention, the fixed data supplying means supplies data concerning the type of laundry and the desired degree of dryness.

In accordance with a further feature of the invention, the temperature gradient determining means begins the given early stage when the drying system is switched on.

In accordance with an added feature of the invention, there is provided a temperature sensor connected to the temperature gradient determining means, and the temperature gradient determining means begins the given early stage when the sensor has sensed a given minimum temperature and after it has sensed that the drying system and the laundry to be dried have reached substantially the same temperature.

In accordance with an additional feature of the invention, the temperature gradient determining means includes means for measuring the temperature difference existing between the drying system and the surrounding air before the beginning of the drying process.

In accordance with again another feature of the invention, the temperature gradient determining means includes means for measuring a time interval between the occurrence of two fixed temperature values.

In accordance with again a further feature of the invention, the temperature gradient determining means includes means for measuring the temperature change between two fixed points in time.

In accordance with again an added feature of the invention, there is provided a device connected to the computing unit for measuring and displaying the time remaining until the calculated end of the drying process.

In accordance with again an additional feature of the invention, there is provided a device connected to the computing unit for setting a fictitious operating time until the calculated operating time becomes available, and means for correcting the fictitious operating time when the calculated operating time is available.

In accordance with yet another feature of the invention, there is provided a temperature measuring device, the computing unit including two limit value switches each being set to a given fixed temperature and each having an input connected to the temperature measuring means and an output, a time measuring device having a start terminal connected to the output of one of the limit value switches, a stop terminal connected to the output of the other of the limit value switches and a difference value output, a computer connected to the difference value output for calculating the operating time from the differences between the fixed temperatures as well as the duration of the drying process between the fixed temperatures and a value corresponding to a certain given residual moisture supplied by the fixed data supplying means, the calculated value being translated in the computer into a quantity for driving the process control unit or program cycle drive unit. This arrangement is especially well suited for the version of the method, wherein the time interval between two fixed temperature values is measured for determining the gradient. If the version of the method is chosen wherein the temperature change between two fixed points in time is measured for determining the gradient, there is provided, in accordance with yet a further feature of the invention, a temperature measuring device, the computing unit including a time measuring device having two trigger signal outputs and a switching output, two instant signal value storage devices having trigger inputs connected to the trigger signal outputs as well as instant value inputs and outputs, a throw switch being controllably connected to the switching output of the time measuring device and having an input connected to the temperature measuring means and outputs connected to the instant value inputs, difference forming means having inputs connected to the outputs of the intant value storage devices and an output, a computer connected to the output of the difference forming means for calculating the operating time from a difference value supplied by the difference forming means as well as elapsed time between two trigger signals and a value corresponding to a given certain residual moisture supplied by the fixed data supplying means, the computer being operable to translate the signals supplied thereto into a proportional quantity for driving the process control unit or program cycle drive unit.

In accordance with a concomitant feature of the invention, the computer has an output, and there is provided another time measuring device being started at the beginning of the drying process and having an output, time difference forming means having one input connected to the output of the other time measuring device, another input connected to the output of the computer and an output, and a display unit having an input connected to the output of the time difference forming means to indicate the time remaining until the end of the drying process.

Other features which are considered as characteristic for the invention are set forth in the appended claims.

Although the invention is illustrated and described herein as embodied in a method of automatically controlling the drying process in a laundry-drying system, and equipment for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
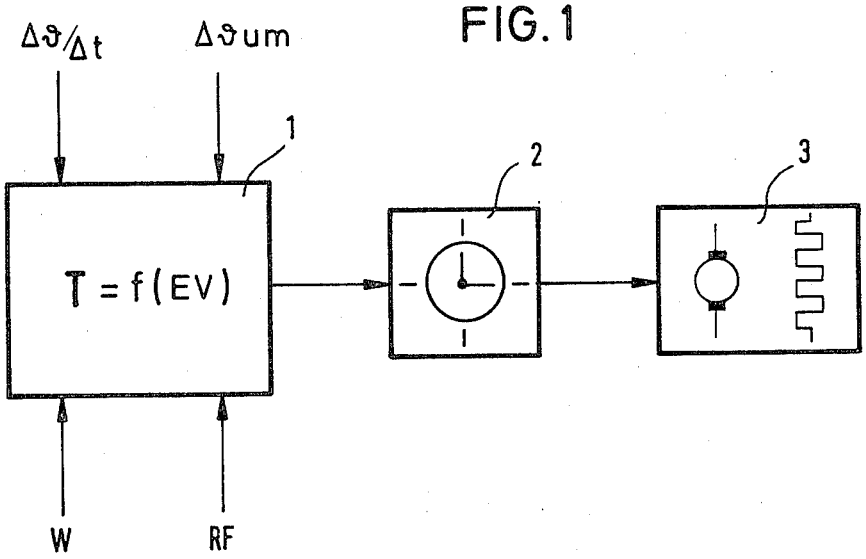
FIG. 1 is a schematic and block diagram of a device for carrying out the method according to the invention.

Referring now to the figures of the drawing and fist particularly to FIG. 1 thereof, there is seen a computing or evaluation unit 1 with four inputs for the input variables EV, the temperature gradient $\Delta\theta/\Delta$ t, the temperature difference above the surroundings $\Delta\theta$ um, a laundry-dependent dry program W, and residual moisture RF. The computing unit 1 follows the functional equation T=f (EV), and gives the computed output signal to the process control or run-down unit 2, which can be an adjustable timer. This timer controls the consuming devices 3 contained in the drying system (drive motor, heater), in a conventional manner.

Figure 2:
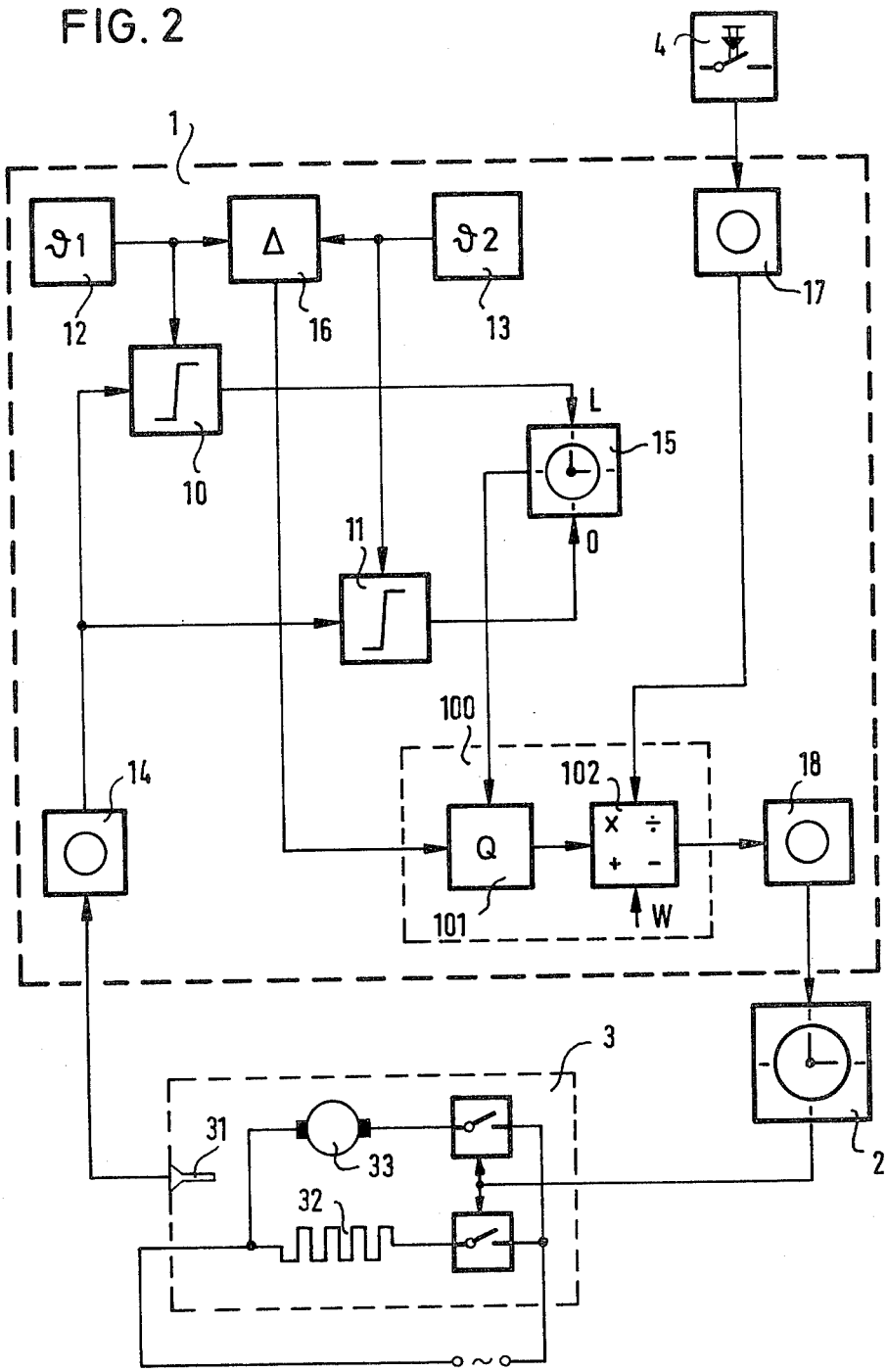
FIG. 2 is a more detailed representation of a schematic and block diagram for the device as compared to FIG. 1, with time measurements between two fixed temperature values.

The computing unit 1 in FIG. 2 contains two limit value switches 10 and 11, which are pre-set by two temperature mark-generators 12 and 13. The inputs of the switches 10, 11 to be compared are connected to a signal processor or measured value converter 14, having input signals which originate from a temperature sensor 31 of the drying system.

When the temperature reported from the temperature sensor 31 reaches the temperature mark $\theta_1$, the limit value switch 10 delivers a start signal L to the time measuring device 15, which keeps running until the temperature $\theta_2$ reached for the purpose of determining the duration. As soon as the temperature reported from temperature sensor 31 has reached the temperature mark $\theta_2$, the limit value switch 11 sends a stop signal 0 to the time measuring device 15, which stops at this point and transmits the value for the measured duration to a quotient-forming means 101 of a computer 100. The quotient forming means 101 receives a value indicating the temperature difference between the two temperature marks $\theta_1$ and $\theta_2$ from a difference value forming means or differential amplifier 16, and forms a signal for the temperature gradient $\Delta\theta/\Delta$ t from these. A further calculation stage 102 of the computer 100 calculates the operating time or duration from the values; laundry type W, temperature quotient $\Delta\theta/\Delta$ t and residual moisture, supplied over an input-key 4 and signal processer 17, and the stage 102 then transmits the value for operating duration to a signal process 18, which in turn, prepares the signal for the program cycle control unit 2. When the operating time calculated by the computer 100 has elapsed, the program cycle control unit 2 discontinues the operation of the power consuming components in the drying system 3 corresponding to a predetermined program. In general, first heating means 32 are taken from the network voltage, and after a certain cooling period the drive motor 33 is disconnected.

Figure 3:
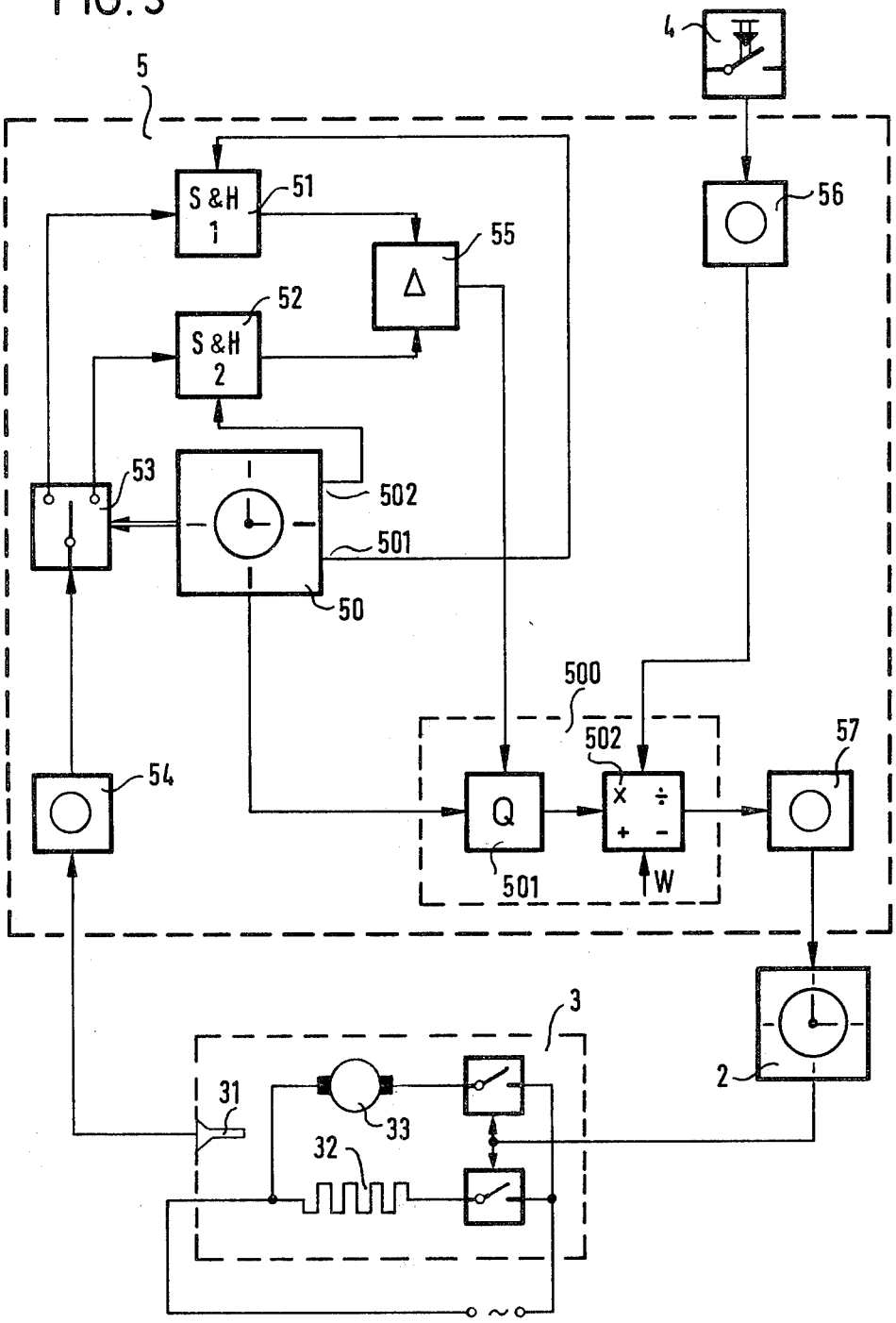
FIG. 3 is a schematic and block diagram similar to FIG. 2, with a measurement of the temperature difference between two fixed time marks.

The computing unit 5 shown in FIG. 3 contains a time-measuring device 50 with two internally switched time-marks. The time measuring device 50 has two trigger signal outputs 501 and 502, each of which transmit a trigger signal to the corresponding instant value storage device 51, 52 when its associated time mark is reached. The two instant signal value storage devices 51 and 52 can include so-called sample-and-hold circuits which are conventionally used in electronic circuitry. The time measuring device 50 also has a switching output which is connected to a throw switch 53. This throw-over switch is connected through a signal processer or measured value converter 54 with a temperature sensor 31 of the drying system 3, and the two outputs of the switch 53 are connected to instantaneous value inputs of the instantaneous value storage devices 51 and 52.

When the time measuring device 50 reaches the first respective time mark, it switches the throw switch 53 either to its left-hand output which is to the instant value storage device 51, or (at the second time mark) to its right-hand output which is to the instant value storage device 52. Just at this instant, the respective instant value storage 51 is triggered by the time measuring device 50, so that the temperature value which has just been sensed by the temperature sensor 31 in the drying system is stored as the instant value in the instant value storage device. This instant value is present at the output of each respective instant value storage device 51, 52, and is connected to a differential amplifier or difference value former 55, which transfers its output signal to the quotient forming means 501 of the computer 500, when the second temperature value is given out from the instant value storage device 52.

The quotient forming means and the other calculation stage 502 of the computer 500 function in a similar manner to the corresponding circuit stages in FIG. 2. The quotient forming means 501 also receives a signal representing the time difference between the two time marks in the time measuring device 50. The inputs for the value of the residual moisture is effected through the key 4 and the signal processer 56, similar to the corresponding arrangement in FIG. 2.

The signal processer 57 processes the signal which contains the operating duration that was calculated by the computer 500 for the program cycle control unit 2, which operates in the same manner as in the example according to FIG. 2.

Figure 4:
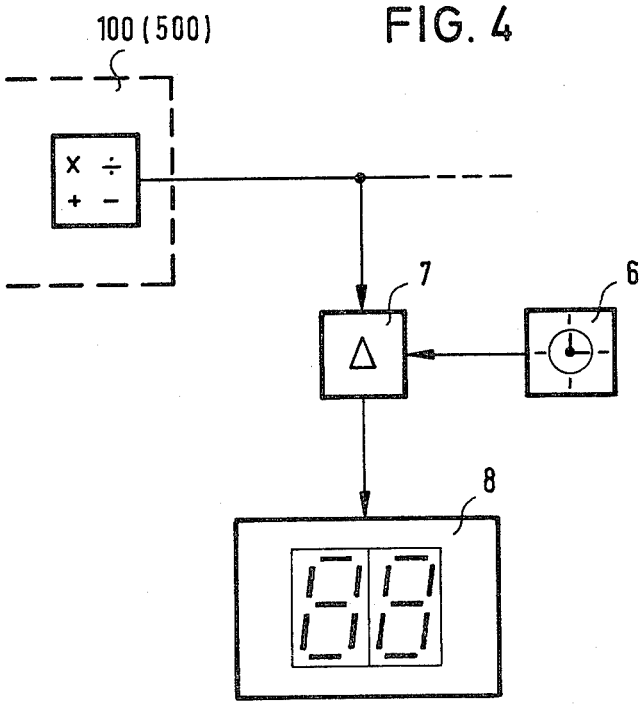
FIG. 4 is an additional schematic and block diagram supplementing those of FIGS. 2 and 3 for a device for indicating the time still remaining.

An advantageous arrangement which makes it possible to display the remaining operating time is shown in FIG. 4. The time measuring device 6 can be one of the time measuring devices contained in the control circuitry, if the control circuitry is started at the beginning of the drying process, so that the whole time elapsed after the start of the drying process, can be measured. The output of the time measuring device 6 is connected to one of the inputs of a difference value former 7, another input of which is connected to the output of the computer 100 or 500. This difference value former 7 can, for example, form the difference between the elapsed operating time and the calculated operating time furnished by the computer at predetermined periodic intervals, and feed its output to a display unit 8. The display unit can be disposed in the operating panel of the associated appliance, and it indicates the still to be expected duration of the running drying process for the operator.

All block diagrams used to indicate circuitry in the illustrated typical embodiment represent conventional electronic circuits. For this reason, it has been decided to forego the individual representation of the circuits. Other forms of execution which serve to achieve the method according to the invention are not excluded by these representations.

There is claimed:

1. Method of automatically controlling the drying process of a laundry drying system until a given desired degree of dryness is reached, including heating means, a drive for the drying system, a control device for controlling the drive and heating means, and means for supplying system-related fixed data concerning the drying of particular laundry, which comprises determining the gradient of rising air temperature leaving the drying system during a given early phase of the drying process, calculating a required operating time for the heating means and the drive from the determined gradient and the system-related fixed data, and feeding the calculated operating time as an input to the control device.

2. Method according to claim 1, which comprises supplying the type of laundry and the desired degree of dryness as the fixed data.

3. Method according to claim 1, which comprises beginning the early phase of the drying process when the drying system is switched on.

4. Method according to claim 1, which comprises beginning the early phase of the drying process when a given minimum temperature is reached after the drying system and the laundry to be dried have reached substantially the same temperature.

5. Method according to claim 3, which comprises measuring and taking into account the temperature difference existing between the drying system and the surrounding air before the beginning of the drying process, during the determination of the temperature gradient.

6. Method according to claim 1 or 5, which comprises measuring the time interval between the occurrence of two fixed temperature values for determining the temperature gradient.

7. Method according to claim 1 or 5, which comprises measuring the temperature change between two fixed points in time for determining the temperature gradient.

8. Method according to claim 6, which comprises displaying the time remaining until the calculated end of the drying process.

9. Method according to claim 7, which comprises displaying the time remaining until the calculated end of the drying process.

10. Method according to claim 6, which comprises setting a fictitious operating time until the calculated operating time becomes available, and correcting the fictitious operating time when the calculated operating time is available.

11. Method according to claim 7, which comprises setting a fictitious operating time until the calculated operating time becomes available, and correcting the fictitious operating time when the calculated operating time is available.

12. Method according to claim 8, which comprises setting a fictitious operating time until the calculated operating time becomes available, and correcting the fictitious operating time when the calculated operating time is available.

13. Device for performing a method of automatically controlling the drying process of a laundry drying system until a given desired degree of dryness is reached, comprising heating means, a drive for the drying system, a process control unit connected to said heating means and drive for controlling the drying process, means for supplying system-related fixed data concerning the drying of particular laundry, means for determining the gradient of rising air temperature leaving the drying system during a given early phase of the drying process, and a computing unit including said temperature gradient determining means and being connected to said fixed data supplying means and said process control unit for calculating a required operating time for said heating means and drive from the determined gradient and the system-related fixed data and feeding the calculated operating time as an input to said process control unit.

14. Device according to claim 13, wherein said fixed data supplying means supplies data concerning the type of laundry and the desired degree of dryness.

15. Device according to claim 13, wherein said temperature gradient determining means begins the given early stage when the drying system is switched on.

16. Device according to claim 13, including a temperature sensor connected to said temperature gradient determining means, and said temperature gradient determining means begins the given early stage when said sensor has sensed a given minimum temperature and after it has sensed that the drying system and the laundry to be dried have reached substantially the same temperature.

17. Device according to claim 15, wherein said temperature gradient determining means includes means for measuring the temperature difference existing between the drying system and the surrounding air before the beginning of the drying process.

18. Device according to claim 13 or 17, wherein said temperature gradient determining means includes means for measuring a time interval between the occurrence of two fixed temperature values.

19. Device according to claim 13 or 17, wherein said temperature gradient determining means includes means for measuring the temperature change between two fixed points in time.

20. Device according to claim 18, including means connected to said computing unit for measuring and displaying the time remaining until the calculated end of the drying process.

21. Device according to claim 19, including means connected to said computing unit for measuring and displaying the time remaining until the calculated end of the drying process.

22. Device according to claim 18, including means connected to said computing unit for setting a fictitious operating time until the calculated operating time becomes available, and means for correcting the fictitious operating time when the calculated operating time is available.

23. Device according to claim 19, including means connected to said computing unit for setting a fictitious operating time until the calculated operating time becomes available, and means for correcting the fictitious operating time when the calculated operating time is available.

24. Device according to claim 20, including means connected to said computing unit for setting a fictitious operating time until the calculated operating time becomes available, and means for correcting the fictitious operating time when the calculated operating time is available.

25. Device according to claim 13, including temperature measuring means, said computing unit including two limit value switches each being set to a given fixed temperature and each having an input connected to said temperature measuring means and an output, a time measuring device having a start terminal connected to said output of one of said limit value switches, a stop terminal connected to said output of the other of said limit value switches and a difference value output, a computer connected to said difference value output for calculating the operating time from the differences between said fixed temperatures as well as the duration of the drying process between said fixed temperatures and a value corresponding to a given residual moisture supplied by said fixed data supplying means, said calculated value being translated in said computer into a quantity for driving said process control unit.

26. Device according to claim 13, including temperature measuring means, said computing unit including a time measuring device having two trigger signal outputs and a switching output, two instant signal value storage devices having trigger inputs connected to said trigger signal outputs as well as instant value inputs and outputs, a throw switch being controllably connected to said switching output of said time measuring device and having an input connected to said temperature measuring means and outputs connected to said instant value inputs, difference forming means having inputs connected to said outputs of said instant value storage devices and an output, a computer connected to said output of said difference forming means for calculating the operating time from a difference value supplied by said difference forming means as well as elapsed time between two trigger signals and a value corresponding to a given residual moisture supplied by said fixed data supplying means, said computer being operable to translate the signals supplied thereto into a proportional quantity for driving said process control unit.

27. Device according to claim 25 or 26, wherein said computer has an output, and including another time measuring device being started at the beginning of the drying process and having an output, time difference forming means having one input connected to said output of said other time measuring device, another input connected to said output of said computer and an output, and a display unit having an input connected to said output of said time difference forming means.

28. Method according to claim 9, which comprises setting a fictitious operating time until the calculated operating time becomes available, and correcting the fictitious operating time when the calculated operating time is available.

29. Device according to claim 21, including means connected to said computing unit for setting a fictitious operating time until the calculated operating time becomes available, and means for correcting the fictitious operating time when the calculated operating time is available.

* * * * *